United States Patent [19]

Schäfer

[11] Patent Number: 4,685,507

[45] Date of Patent: Aug. 11, 1987

[54] PROCESS FOR THE STAGED HEATING OF A MATERIAL IN A TREATMENT APPARATUS AND SUBSEQUENT COOLING THEREOF

[76] Inventor: Otmar U. Schäfer, Pienzenauerstrasse 9, 8000 München 80, Fed. Rep. of Germany

[21] Appl. No.: 508,591

[22] Filed: Jun. 28, 1983

[30] Foreign Application Priority Data

Jul. 7, 1982 [DE] Fed. Rep. of Germany ..... 3225403

[51] Int. Cl.[4] ..... F28C 3/00; F28D 21/00

[52] U.S. Cl. ..... 165/2; 165/18; 165/61; 422/26; 422/208; 422/295

[58] Field of Search ..... 165/1, 2, 14, 18, 108, 165/110, 61, DIG. 12; 422/25, 295, 26, 292, 208

[56] References Cited

U.S. PATENT DOCUMENTS

| | | | |
|---|---|---|---|
| 2,082,460 | 6/1937 | Omstead | 422/295 |
| 2,579,932 | 12/1951 | Kobernick | 165/DIG. 12 X |
| 2,808,234 | 10/1957 | Rosenblad | 165/108 |
| 3,107,975 | 10/1963 | Linder | 422/295 |
| 3,109,486 | 11/1963 | Hausen | 165/12 |
| 3,239,200 | 3/1966 | Brown, Jr. | 422/208 |
| 3,366,442 | 1/1968 | Neiss | 422/25 |
| 3,511,169 | 5/1970 | Fritzberg et al. | 422/295 |
| 3,556,201 | 1/1971 | Sander | 165/2 |
| 3,672,009 | 6/1972 | Pike | 422/208 |
| 3,773,466 | 11/1973 | Linder | 422/295 |
| 3,897,818 | 8/1975 | Champel | 422/26 |
| 4,020,895 | 5/1977 | Schafer | 165/2 X |
| 4,026,347 | 5/1977 | Schafer | 165/2 |
| 4,071,075 | 1/1978 | Hinkle | 165/2 |
| 4,072,184 | 2/1978 | Hinkle | 165/61 X |
| 4,146,084 | 3/1979 | Hinkle | 165/2 |
| 4,331,629 | 5/1982 | Huling | 422/25 |
| 4,441,406 | 4/1984 | Becker et al. | 422/25 |

FOREIGN PATENT DOCUMENTS

| | | | |
|---|---|---|---|
| 0023196 | 1/1981 | European Pat. Off. | 422/292 |
| 1492381 | 7/1970 | Fed. Rep. of Germany | 422/208 |
| 2465969 | 4/1981 | France | 165/1 |
| 159205 | 2/1983 | German Democratic Rep. | 165/110 |
| 2061484 | 5/1981 | United Kingdom | 165/61 |
| 245024 | 4/1969 | U.S.S.R. | 422/208 |

*Primary Examiner*—Albert W. Davis, Jr.
*Assistant Examiner*—John K. Ford

[57] ABSTRACT

In a process for heating material in a treatment apparatus, using heating vapor, followed by cooling of the material, the condensate from the heating stage is stored in a storage container and the heat content thereof is utilized for the recovery of heat for further use in the process, by the condensate, in a subsequent heating cycle, being returned directly to the treatment apparatus, for preheating of fresh material to be subsequently heated therein. After being cooled, the condensate is discharged from the treatment apparatus and removed from the process.

9 Claims, 20 Drawing Figures

PROCESS FOR THE STAGED HEATING OF A MATERIAL IN A TREATMENT APPARATUS AND SUBSEQUENT COOLING THEREOF

BACKGROUND OF THE INVENTION

A process comprising preheating a material to be treated or processed, heating the material by means of hot vapour such as steam and then cooling the material has been proposed (DE-OS No. 29 43 797) for use in a piece of equipment such as a press or a reaction vessel. That process is operated partly with a heat carrier or exchange agent in liquid form and partly with a heat carrier or exchange agent in vapour form, for example, using water and water vapour, whereby the operating pressure in the installation and thus also the capital investment costs of the installation can be held at a low level. Before that process makes the transition to using vapour as the heat exchange agent, in the last heating stage, the liquid heat exchange agent which is present in the treatment apparatus and in a part of the conduit system is displaced into a liquid storage means, by means of the vapour in the installation. The treatment apparatus is then further heated and held at the high temperature in the heating phase. In that operation, the liquid storage means is disconnected from the treatment apparatus and the vapour which condenses in the treatment apparatus by giving off heat to the material to be heated is passed to a feed water vessel, in the form of condensate, by way of a condensate trap arrangement. From the feed water vessel, the feed water constituted in part by the condensate is recycled to the vapour boiler or like vapour-producing source, for producing the heating vapour. Thereafter, the treatment apparatus is disconnected again from the boiler and cooled in a plurality of steps in succession by increasingly cooler cooling fluid from an array of three liquid storage means, which also include the above-mentioned storage means that previously received the liquid heat exchange agent from the system. That arrangement and mode of operation thus provide for waste heat recovery, with a form of thermal recycling procedure. In spite of the comparatively low level of manufacturing expenditure involved in the installation, the level of heat requirement and thus consumption and at the same time the amount of electrical energy consumed, in comparison with comparable installations without heat recovery, can be reduced to less than half.

However, a disadvantage with the above-indicated process is that the considerable heat recovery effect, by means of the condensate which is passed to the feed water vessel of the boiler or vapour producer, can only be effected with a condensate which does not suffer from contamination or fouling, as such contamination would also contaminate the boiler and thus detrimentally affect operation thereof.

SUMMARY OF THE INVENTION

An object of the present invention is to provide a process for the stepwise heating of a material and subsequent cooling thereof, with a heat recovery or recycling effect, to increase operating efficiency of the process.

Another object of the present invention is to provide a process for the staged heating of material by means of a hot vapour, and subsequent cooling, wherein condensate from the hot vapour can be utilised for heat recycling, even when the vapour is contaminated from the material to be treated.

Still another object of the present invention is to provide a process for treating a material by heating it by means of hot vapour and then cooling the material, wherein condensate from the hot vapour can be removed from the process at a suitably reduced temperature.

In accordance with the present invention, these and other objects are attained by a process for the staged or stepwise heating of a material in a treatment apparatus, followed by cooling thereof, wherein the material is first preheated in a preheating phase, and then heated in a heating phase, using a hot vapour or steam, followed by possibly natural cooling of the material. The condensate produced in a heating phase, from the heating vapour, is stored in at least one storage container and subsequently passed back to the treatment apparatus for the phase of preheating fresh material in a subsequent treatment cycle. The cooled condensate is then removed from the process.

The condensate which is fed into the storage container may also be contaminated, so that it can no longer be satisfactorily used for feeding a boiler. In spite of that, the stored condensate can be used again in a subsequent heating operation for preheating the treatment apparatus and the material to be treated therein, especially as it can generally be assumed that the treatment apparatus will be used to treat the same or similar types of articles, for example rubber articles which are to be vulcanized, in a succession of treatment cycles and will therefore not be switched frequently from one type of article to another. In addition, the condensate fluid, in such re-use thereof, is cooled down to such a low temperature level that it can subsequently be readily drained from the treatment apparatus and removed from the process.

The process according to this invention may be applied both in an indirect heating mode, for example when heating a laminate in a press that forms the treatment apparatus, as well as in a direct heating mode for heating the material to be treated, for example when heating material to be vulcanized, in an autoclave. In its simplest form of use, the process may be restricted to utilizing the condensate heat, in which case the treated material is cooled down in a free cooling mode, after the heating phase is concluded.

Preferably, the storage container for the condensate is a component of a fluid circuit which can be connected to the treatment apparatus for example in the manner disclosed in DE-OS No. 29 43 797, the circuit having storage containers which are each intended for accommodating a heat carrier or exchange fluid at a given temperature level. Subsequently to the heating phase, the treatment apparatus can then be supplied with cooling water which is subsequently mixed with the condensate in the storage container or accommodated in a further storage container at a correspondingly lower temperature level, from which it is used, in the next heating cycle, for the first step of preheating the treatment apparatus and the fresh material therein.

Other objects, features and advantages of the invention will be apparent from the following description of preferred embodiments.

DESCRIPTION OF PREFERRED EMBODIMENTS

Figure 1:
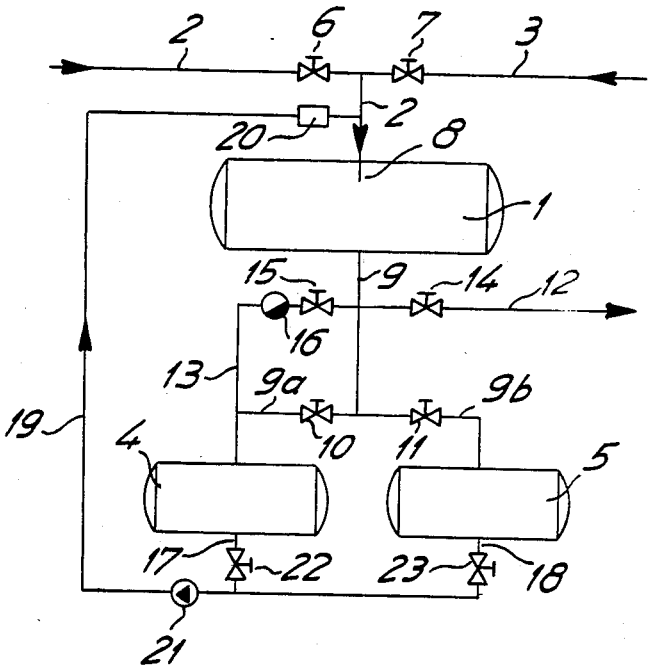
FIG. 1 is a diagrammatic view of a first embodiment of an apparatus for carrying out the process, having two storage containers associated with an autoclave, FIGS. 1*a*–1*g* each show a diagrammatic illustration of the apparatus of FIG. 1, in respective ones of seven consecutive stages in the process.

Referring firstly to FIG. 1, shown therein is an apparatus for carrying out a first embodiment of the process for stepwise heating and cooling of a material to be treated or processed. Thus, in FIG. 1, associated with an autoclave 1 is an apparatus for directly heating and directly cooling the material to be treated therein, for example rubber members (not shown) which are to be vulcanized therein. A supply line or conduit 2 connects to the autoclave 1 from above, for feeding hot vapour such as steam from a conventional hot vapour source (not shown) into the autoclave for heating purposes, and a supply line or conduit 3 which communicates with the line or conduit 2 just upstream of the autoclave 1, for supplying a cooling fluid, for example water, from an external cooling fluid source (not shown). The apparatus also has a further heat carrier or heat exchange agent conduit system including two storage containers 4 and 5, and serves to make use of the heat content of the condensate which is produced when the material in the autoclave 1 is heated by the heating vapour giving up heat to that material, and also to make use of further heat which is produced in the phase of cooling the autoclave 1, together with the material therein.

A shut-off member or valve 6 disposed on the supply conduit 2 upstream of the location at which the supply conduit 3 communicates therewith, and a shut-off or valve member 7 on the supply conduit 3 itself are provided to permit the autoclave 1 to be supplied selectively with heating vapour or cooling water as required in operation thereof. A nozzle 8 is disposed at the free end of the conduit 2, in the autoclave 1, for spraying on to the material in the autoclave the cooling water or condensate or other heat carrier or heat exchange fluid from the conduit system, as described in greater detail hereinafter.

As illustrated in FIG. 1, the conduit system comprises a discharge conduit or line 9 which extends downwardly from the autoclave 1 and which communicates with the storage container 4 from above, by way of a first branch conduit 9*a*, and with the storage container 5 from above, by way of a second branch conduit 9*b*. Each of the two branch conduits 9*a* and 9*b* includes a shut-off member or valve 10 and 11 respectively, the function of which will be described in greater detail hereinafter.

Upstream of the branch conduits 9*a* and 9*b*, two further branch conduits 12 and 13 also branch off the discharge conduit 9. Of the conduits 12 and 13, the conduit 12 goes to the exterior, to a suitable discharge means (not shown), while the conduit 13 communicates with the branch conduit 9*a*, downstream of the shut-off member 10 which is by-passed by the conduit 13. In that arrangement, each of the two branch conduits 12 and 13 also includes a shut-off member or valve 14 and 15 respectively, while a condensate trap 16 is also disposed in the part of the branch conduit 13 between the shut-off member 15 and the point at which the branch conduit 13 communicates with the branch conduit 9*a*. The condensate trap 16 may be omitted if the maximum water level in the storage container 4 is lower than the lower edge of the autoclave 1.

Finally, the two storage containers 4 and 5 are connected by way of further outlet connections 17 and 18 respectively to a recycling conduit or line 19 which, by way of a non-return valve 20, communicates with the supply conduit 2 between the shut-off member 6 and the autoclave 1. A delivery pump 21 is disposed in the conduit 19 between the point at which the outlet connection 17 communicates therewith, and the non-return valve 20, while further shut-off members or valves 22 and 23 respectively are also provided in each of the outlet connections 17 and 18.

The above-described installation for heating and recooling material to be treated or processed in the autoclave is operated, depending on the treatment or processing cycle, in seven treatment stages which will be described hereinafter with reference to Table I (below) and FIGS. 1*a*–1*g*, the views of which respectively relate with the individual stages in the treatment process. Table I shows the operating states of the pump 21 and the various shut-off members, in the various individual stages in the treatment process, and also the levels of liquid in the two storage containers 4 and 5 at the end of each of the treatment stages, while FIGS. 1*a*–1*g* show the vapour and fluid movements associated with the individual treatment stages. In those Figures, the parts of the two supply conduits 2 and 3 and the parts of the heat exchage conduit system, which are involved in the movement of fluid, are shown in heavier lines, relative to the other parts of the conduits.

Figure 1A:
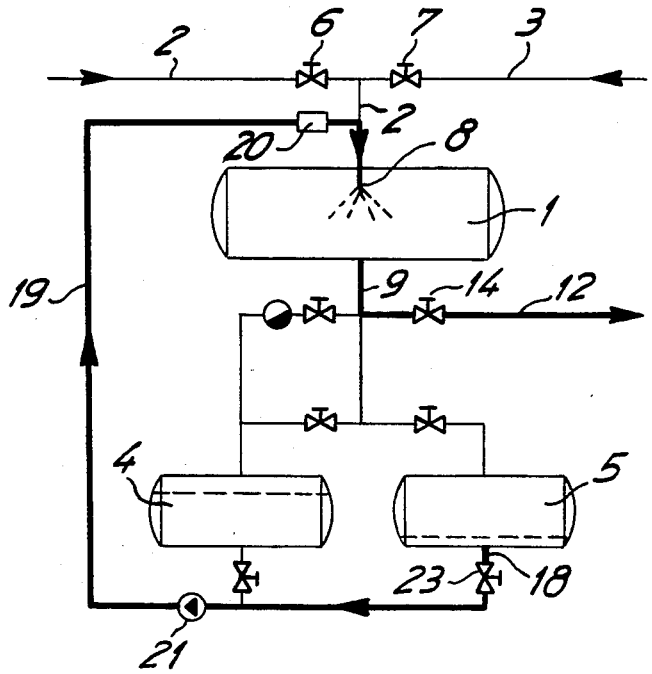
FIG. 1*h* shows the FIG. 1 apparatus in a cooling stage which is modified in comparison with the cooling stage shown in FIG. 1*f*.

FIG. 1*a* shows the first preheating stage for preheating the autoclave 1 and the material to be treated, on the assumption that the treatment cycle which is now beginning was already preceded by another treatment cycle which resulted in the storage containers 4 and 5 being correspondingly filled with heat carrier or exchange fluid at different temperatures (see FIG. 1*g*), as will be described hereinafter at the end of the present treatment cycle which is now beginning. Accordingly the storage container 4 is for example 90% filled with water and 10% filled with condensate, at a common average temperature of 120° to 130° C. (under a suitable pressure above atmospheric), and the storage container 5 is filled with water at a different average temperature of for example 80° C. In this connection, it is irrelevant from the point of view of carrying out the process, whether the condensate was contaminated from the material to be treated, for example rubber bodies to be vulcanized, during the preceding step of treating the material with the vapour or steam. It is to be understood that the term "condensate" used in the above and in the following description is condensed steam, that is, water. However the term "condensate" has been used in order to distinguish the amounts of water occurring in the process which are the result of condensation in autoclave 1. The increased pressure which is required to prevent evaporation of the liquid in the storage container 4 is formed from the expansion vapor from the condensate and if required may be reduced to a desired value for example in a conventional manner which therefore does not require to be described and illustrated herein, as by injecting cooling water.

TABLE I

| Treatment stages | Shown in FIG. | Filling of container at the end of the stage f = full e = empty 4 | 5 | Shut-off members + = open − = closed 6 | 7 | 10 | 11 | 14 | 15 | 22 | 23 | Pump + on − off 21 |
|---|---|---|---|---|---|---|---|---|---|---|---|---|
| 1 prehating I | 1a | f | e | − | − | − | − | + | − | − | + | + |
| 2 preheating II | 1b | e | f | − | − | − | + | − | − | + | − | + |
| 3 heating | 1c | e | f | + | − | − | − | − | + | − | − | − |
| 4 decompression | 1d | about ¼ | ¾ | − | − | − | − | − | + | − | + | + |
| 5 precooling | 1e | f | e | − | − | + | − | − | − | − | + | + |
| 6 cooling I | 1f | f | f | − | + | − | + | − | − | − | − | − |
| 6a (cooling I altern.) | 1h | f | f | − | + | − | + | − | − | − | + | + |
| 7 cooling II | 1g | f | f | − | + | − | − | + | − | − | − | − |

In the first treatment stage, as shown in FIG. 1*a*, being the preheating stage, fluid in the right-hand storage container 5, at a temperature which is lower than the fluid in the storage container 4, being in the embodiment illustrated water at a temperature of 80° C., is sprayed into the autoclave 1 by means of nozzle 8, with the pump 21 and the various shut-off members in the operating states shown in Table I, for the phase of preheating the material in the autoclave, whereby the material is correspondingly heated up and the water is correspondingly cooled down. The cooled water, at a temperature for example of about 40° C., is then discharged to the exterior, into the discharge means, through the discharge conduit 9 and the branch conduit 12.

Figure 1B:
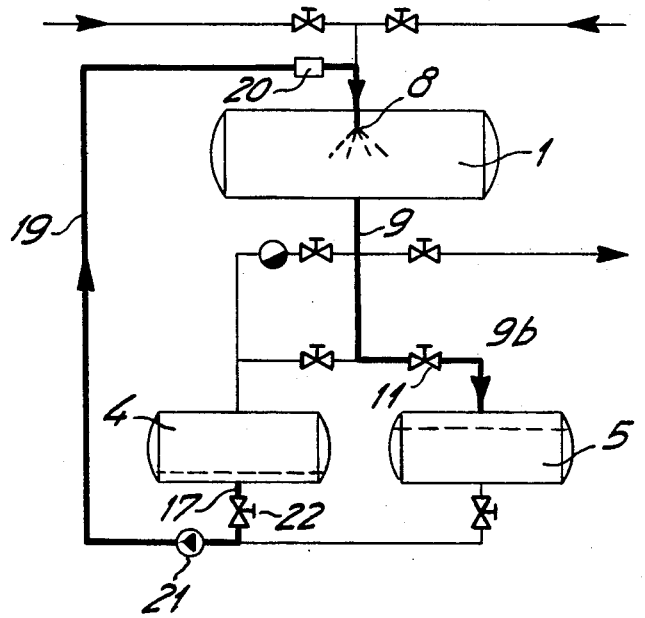

In the second stage shown in FIG. 1*b*, being the first heating stage, the fluid in the left-hand storage container 4, which in the embodiment illustrated is also water at a temperature of about 120° to 130° C., is pumped into the autoclave 1 through the recycling conduit 19 and sprayed by means of the nozzle 8 on to the material to be treated, for further heating thereof. In that operation, the water cools down for example to about 80° C. and flows back into the storage container 5 through the conduit 9 and the branch conduit 9*b*.

Figure 1C:
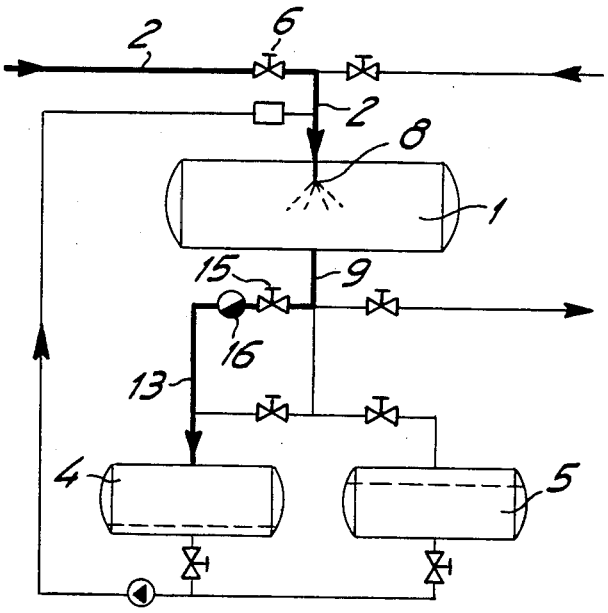

In the second heating stage shown in FIG. 1*c*, the autoclave 1 is supplied with heating vapour (saturated vapour or steam) by way of the supply conduit 2 from a heating boiler or another suitable heating vapour producing source, whereby the material to be treated is heated to the desired treatment temperature of for example 150° to 160° C. The condensate which is formed in the autoclave 1 in that step and which may be contaminated by the material being treated is displaced into the storage container 4 by means of the pressure of about 6 bars which corresponds to the vapour temperature, through the branch conduit 13 with the condensate trap 16. In the storage container 4, the condensate is at a temperature of 120° to 130° C. In that operation, cooling water may be injected (not shown) into the storage container 4 in order to ensure that the differential pressure required for operation of the condensate trap 16 is always available. Such measures are not required if the condensate can flow to the container 4 due to the force of gravity, that is to say, a condensate trap is not provided.

Figure 1D:
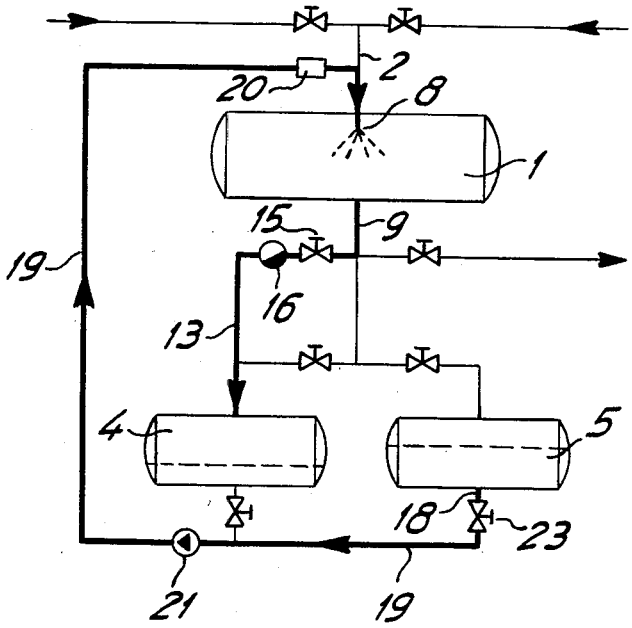

When the treatment operation, as for example vulcanizing the rubber bodies, is concluded, and after the supply of vapour to the autoclave has been terminated, there then follows a decompression stage in which, as shown in FIG. 1*d*, water at a temperature of about 80° C. from the storage container 5 is sprayed into the autoclave 1 until the pressure in the autoclave 1 has been reduced to the pressure of the storage container 4. The water which is initially still in a vapour condition and which is then re-condensed passes into the storage container 4 through the discharge conduit 9 and the branch conduit 13, with the condensate trap 16.

Figure 1E:
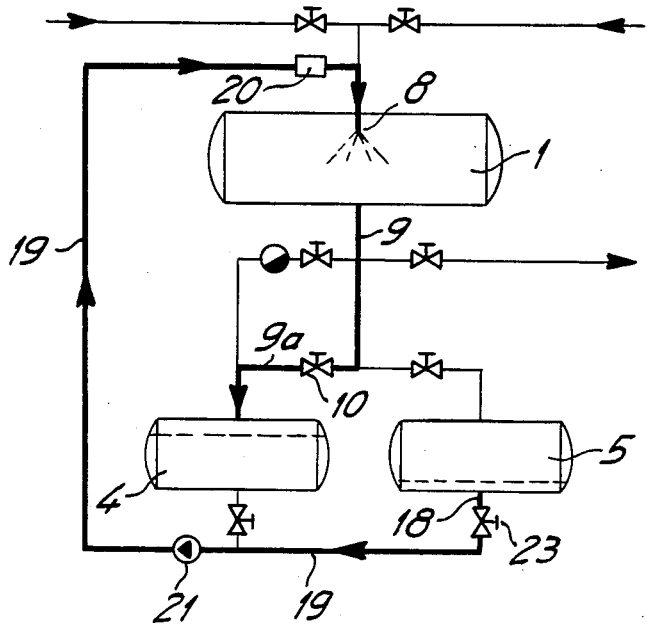

In a subsequent precooling stage which is shown in FIG. 1*e* further water is injected into the autoclave 1 from the storage container 5, while the water flowing out of the autoclave 1, which is heated up by virtue of its effect of causing further cooling of the material and the autoclave 1, now flows back into the storage container 4 which is thereby entirely refilled, through the discharge conduit 9 and the branch conduit 9*a*, without the pressure being substantially higher than the pressure in the container 4.

Figure 1F:
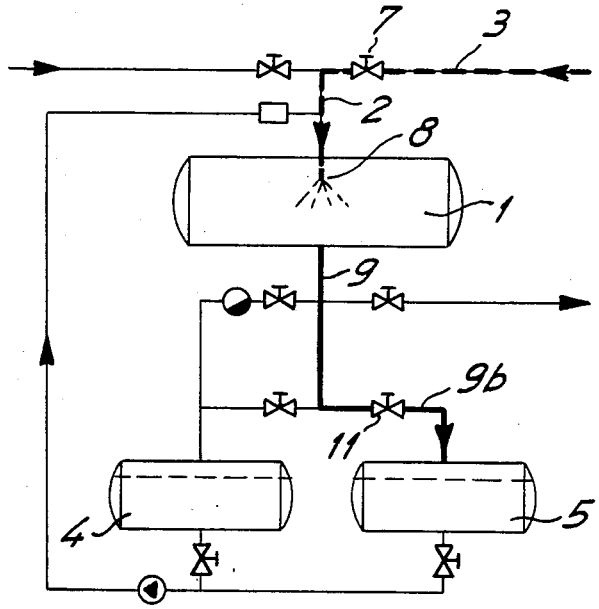

In the following, first cooling stage, as shown in FIG. 1*f*, cooling water is now supplied from the exterior by way of the supply conduit 3 to the material to be treated, which is thus cooled for example to about 125° C., the water being sprayed on to the material by way of the nozzle 8. The water which is heated up to about 80° C. as a result of that operation, upon cooling of the material being treated, flows away into the storage container 5 through the discharge conduit 9 and the branch conduit 9*b*, whereby the storage container 5 is filled with water at a temperature of about 80° C., for a subsequent treatment cycle.

Figure 1G:
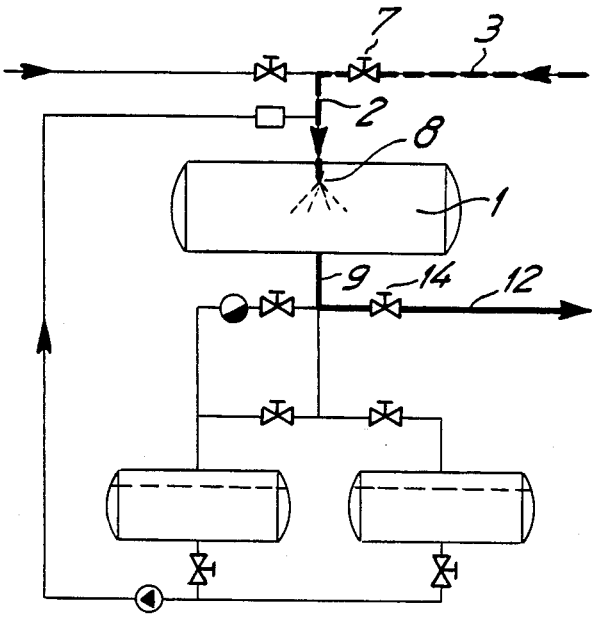

Finally, in a second cooling stage, as shown in FIG. 1*g*, further cooling water is supplied through the supply conduit 3 and sprayed through the nozzle 8 on to the material being treated, which thereby continues to be cooled down, for example to about 40° C. The cooling water which is only slightly heated up in that operation is discharged to the discharge means through the conduit 9 and the branch conduit 12.

Figure 1H:
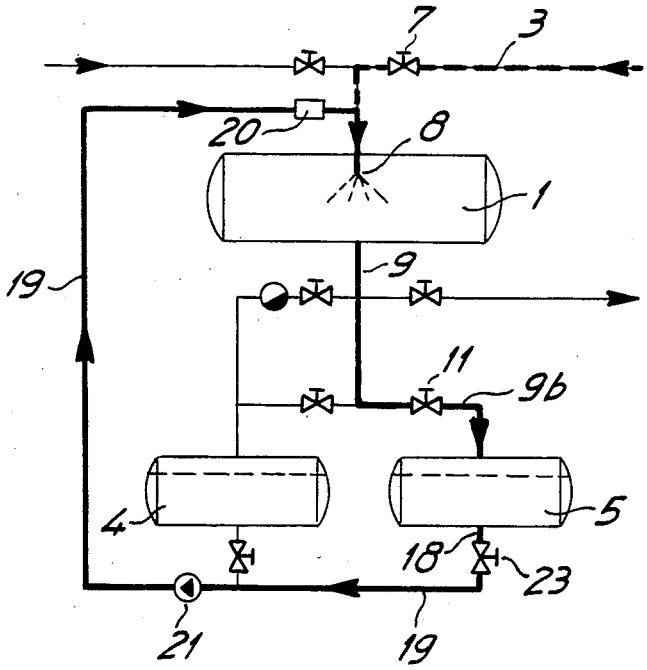

As, after the precooling stage (FIG. 1*e*), the material being treated is initially still at a temperature of about 125° C., the first cooling stage of FIG. 1*f*, which is subsequent to that precooling stage, may also be modified, as shown in FIG. 1*h*, in such a way that, before or at the same time as cooling water is supplied from the supply conduit 3, water is also sprayed into the autoclave 1 from the storage container 5 at a temperature of about 80° C., by means of the pump 21, through the recycling conduit 19, the water then being returned to the storage container 5, together with the cooling water from the supply conduit 3.

Figure 2:
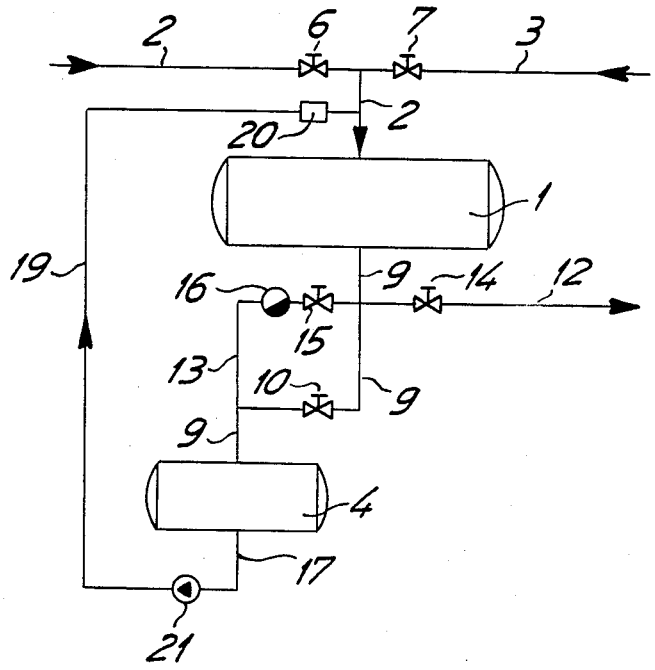
FIG. 2 shows a diagrammatic view of a second embodiment of an apparatus for carrying out the process, which has only one storage container.

Reference will now be made to FIG. 2 which shows an installation in accordance with a second embodiment of the invention. The installation in FIG. 2 is used in a similar manner to the apparatus shown in FIG. 1, for direct heating and cooling of material to be treated or processed in an autoclave, and differs from the above-described installation only by virtue of being of a somewhat simpler design configuration, having only one storage container. In other respects, the installation is the same as that shown in FIG. 1, so that the components of the installation are identified by the same reference numerals, as in the case of the first embodiment. As there is no second storage container 5 and thus no branch conduit leading to the second storage container from the autoclave 1, the discharge conduit 9 from the autoclave 1 is taken directly to the storage container 4 without any branch conduit therefrom, and itself carries the shut-off member 10.

Two modes of operation which differ from each other are described for this installation, the first of those being set out in Table II below and being described as follows, with reference to FIGS. 2*a*–2*f*:

TABLE II

| Treatment stages | Shown in FIG. | Filling of container at the end of the stage 4 | Shut-off members + = open − = closed 6 | 7 | 10 | 14 | 15 | Pump + on − off 21 |
|---|---|---|---|---|---|---|---|---|
| 1 preheating | 2a | empty | − | − | − | + | − | + |
| 2 heating | 2b | empty | + | − | − | − | + | − |
| 3 decompression | 2c | about ¼ | − | + | − | − | + | − |
| 4 cooling I | 2d | full | − | + | + | − | − | − |
| 5 cooling II | 2e | full | − | + | − | + | − | − |
| 4a (cooling I altern.) | 2f | full | − | + | + | − | − | + |

Figure 2A:
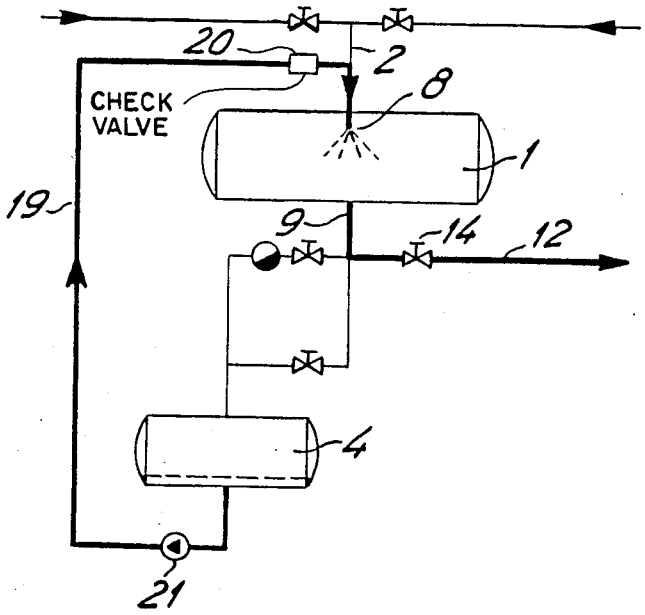
FIGS. 2*a*–2*e* show the apparatus of FIG. 2, in a first mode of operation.

As shown in Table II and as illustrated in FIG. 2*a*, in a single preheating stage which is comparable to the first preheating stage of the first embodiment, water at a temperature of for example about 100° C. is passed into the autoclave 1 from the container 4 by means of the delivery pump 21, through the conduit 19, the non-return valve 20 and the discharge end of the supply conduit 2, the water being sprayed through the nozzle 8 in the autoclave 1 on to the material to be treated therein, whereby the material is subjected to a first preheating operation. The water which is cooled down in that operation flows out through the discharge conduit 9 and the subsequent branch conduit 12 to the exterior, at a suitable discharge means.

Figure 2B:
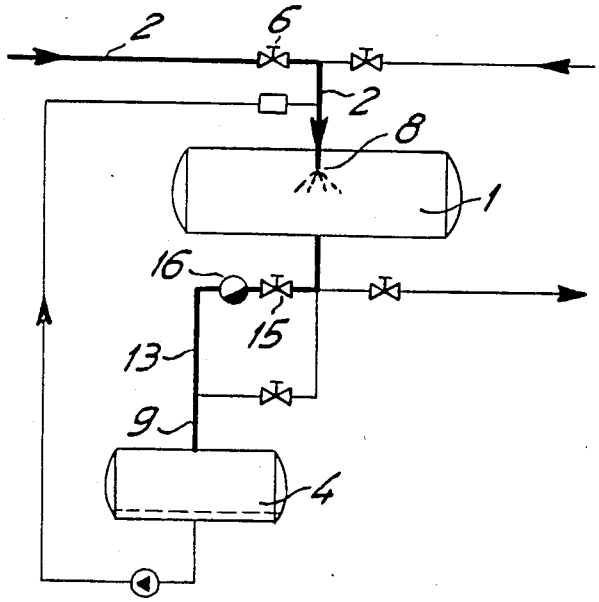

The heating stage which then follows directly and which is shown in FIG. 2*b* is the same as the heating stage of the first embodiment, as illustrated in FIG. 1*c*.

Figure 2C:
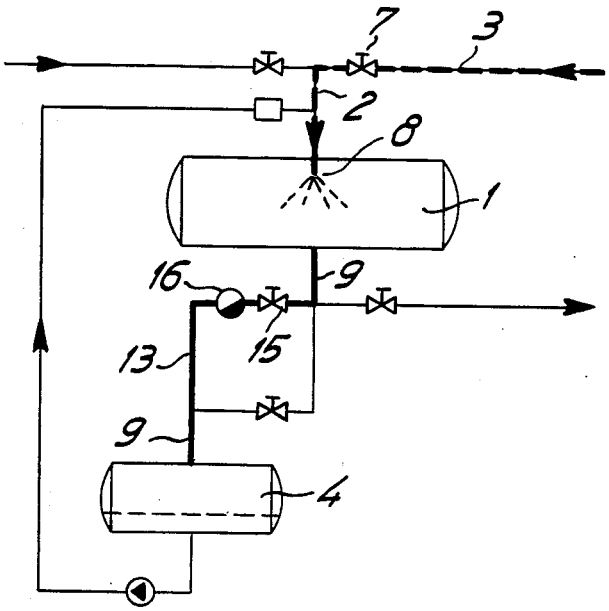

In the following decompression stage, as shown in FIG. 2*c*, decompression is effected by water which is supplied from the outside of the apparatus by way of the supply conduit 3 and which, after being heated up and at least partially evaporated in the autoclave 1, is displaced therefrom in the same manner as in the decompression stage of the first embodiment, as shown in FIG. 1*d*, by way of the discharge conduit 9 and the branch conduit 13 with the condensate trap 16 thereon, being passed into the storage container 4. In this process also, cooling water may be suitably injected in order to ensure that the pressure in the storage container 4 does not exceed for example 1.5 bar.

Figure 2D:
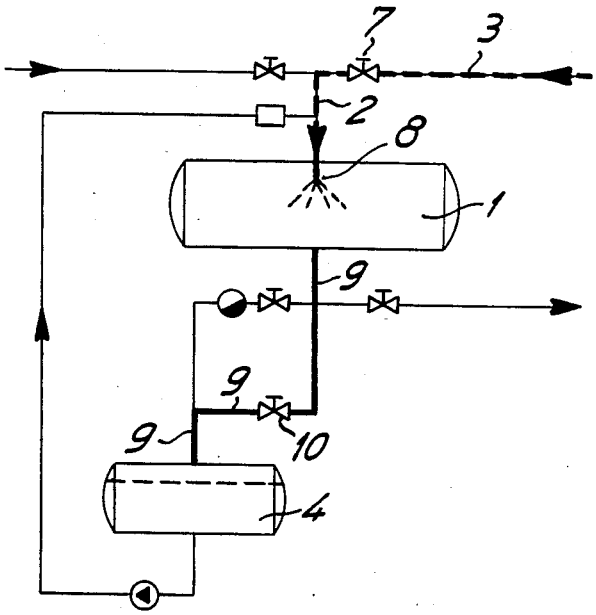

A subsequent first cooling stage which is shown in FIG. 2*d* is again substantially the same as the first cooling stage of the first embodiment, as illustrated in FIG. 1*f*. As the second embodiment has only one storage container 4, the cooling water which is supplied from the outside by way of the supply conduit 3 and which is sprayed through the nozzle 8 in the autoclave 1 and which is heated up by corresponding cooling of the material to be treated is in this process conveyed through the discharge conduit 9 into the storage container 4 until it is full.

Figure 2E:
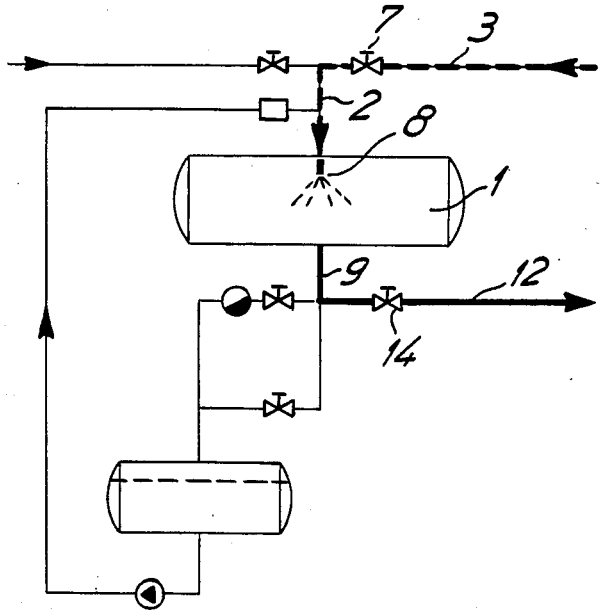

The subsequent second cooling stage which is shown in FIG. 2*e* is again the same as the second cooling stage of the first embodiment, as illustrated in FIG. 1*g*.

Figure 2F:
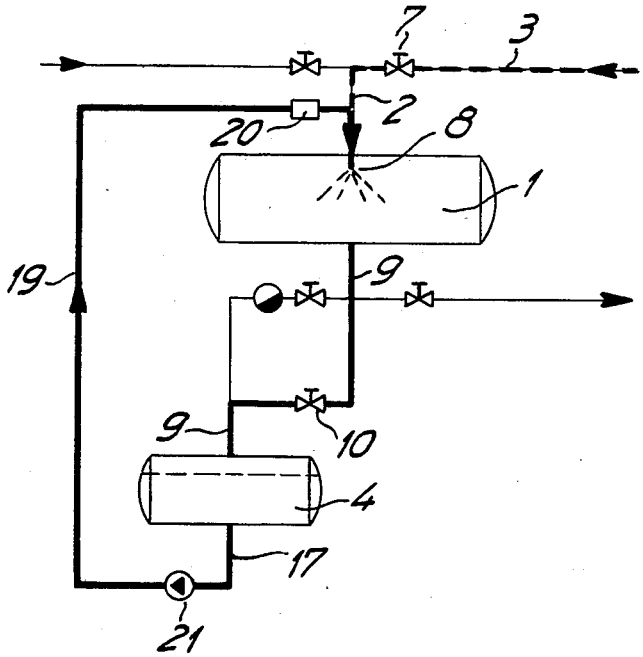
FIG. 2*f* shows a view of a cooling stage which is modified in comparison with the cooling stage shown in FIG. 2*d*, and FIGS. 2*g*–2*j* show the apparatus of FIG. 2 in a second mode of operation.

As shown in FIG. 2*f*, this second embodiment of the process may also be the subject of a modification in the first cooling stage (FIG. 2*d*). The illustrated modification substantially corresponds to the modification in the first cooling stage of the first embodiment, as shown in FIG. 1*h*, wherein the fluid flow circuit now includes the storage container.

Referring now to FIGS. 2*g*–2*j*, the second mode of operation of the installation shown in FIG. 2 differs from the first mode of operation, as described hereinbefore with reference to FIGS. 2*a*–2*f*, more particularly in that the cooling water in this mode of operation in only used for the decompression stage, after the heating stage, and there are no particularly subsequent cooling stages. Table III set out below illustrates the four treatment stages used in this mode of operation, in conjunction with FIGS. 2*g*, 2*h*, 2*i* and 2*j* which relate thereto.

TABLE III

| Treatment stages | Shown in FIG. | Filling of container at the end of the stage 4 | Shut-off members + = open − = closed 6 | 7 | 10 | 14 | 15 | Pump + on − off 21 |
|---|---|---|---|---|---|---|---|---|
| 1 preheating I | 2g | about ½ | − | − | − | + | − | + |
| 2 preheating II | 2h | about ½ | − | − | + | − | + | |
| 3 heating | 2i | about 3/3 | + | − | − | − | + | − |
| 4 decompression | 2j | full | − | + | − | − | + | − |

Figure 2G:
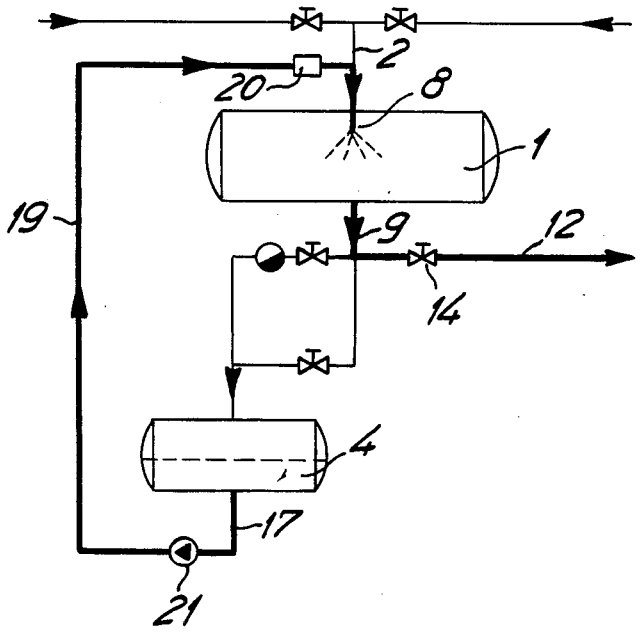
Figure 2H:
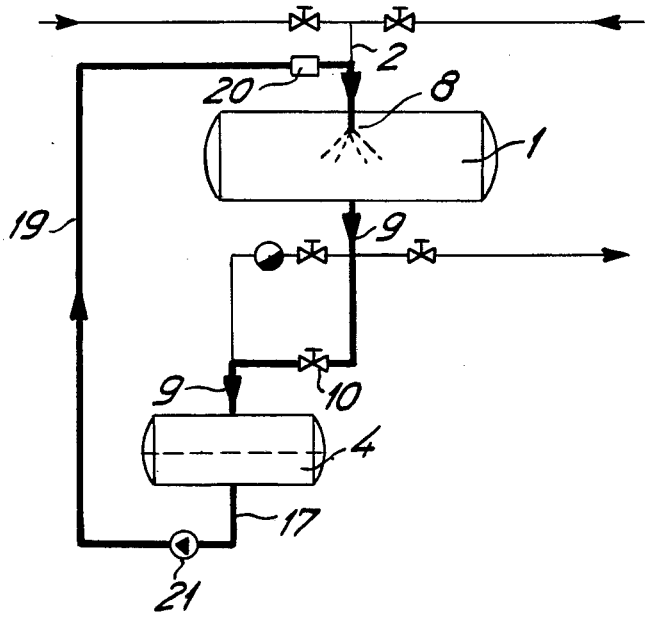

In that form of the process, the mode of operation is as described hereinafter:

Referring to FIG. 2*g*, in a first preheating stage, water stored in the storage container 4 from the preceding treatment cycle, at a suitable pressure above atmospheric and at a temperature of for example 120° to 130° C., is sprayed by means of the pump 21, through the conduit 19 and the nozzle 8, on to the material in the autoclave 1, which initially is still cold, and thereby cooled down to about 40° C., whereupon it is discharged to the discharge means by way of the discharge conduit 9 and the branch conduit 12. As the temperature of the material in the autoclave 1 rises, the cooling of the water sprayed on to the material, caused by the water giving up its heat to the material, also decreases in such a way that, in the second preheating stage shown in FIG. 2*h*, about half the water taken from the container 4, which is still at a temperature of about 80° C., can be pumped back through the conduit 9 to the storage container 4 for re-use.

Figure 2I:
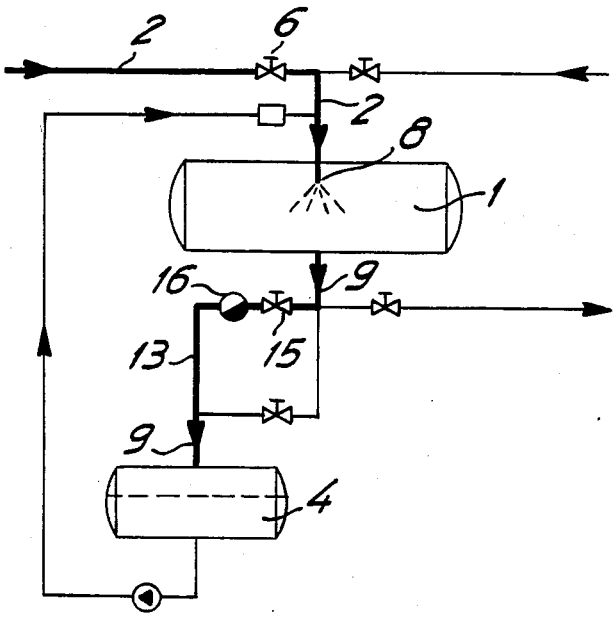

The single heating stage which is shown in FIG. 2*i* is again substantially the same as the single heating stage of the second embodiment, as shown in FIG. 2*b*. As however the storage container 4 was not empty, because of the preceding operations, the storage container 4 in this case is filled up to a higher level, for example about three quarters, by the supply of condensate, in contrast to the second embodiment described above.

Figure 2J:
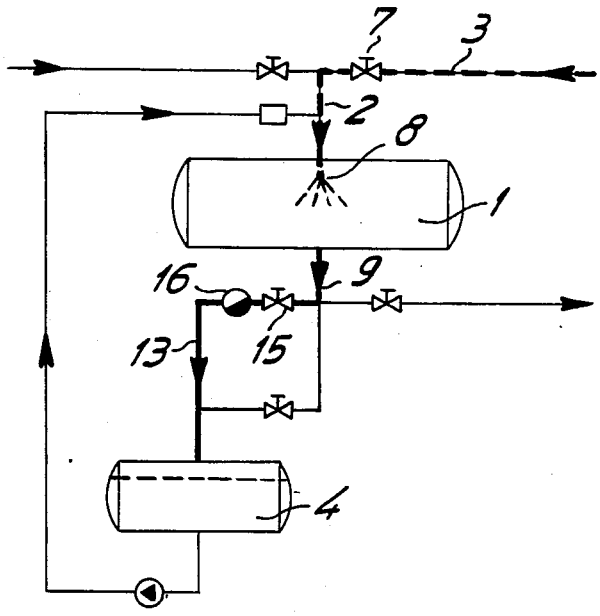

The subsequent decompression stage shown in FIG. 2*j* is substantially the same as the decompression stage of the second embodiment, as illustrated in FIG. 2*c*. The only difference is that, in this third embodiment, the storage container 4 is now completely filled by the condensate from the cooling water which evaporates in that operation, in contrast to the second embodiment.

It was assumed in regard to the drawings that a natural drop is available for discharge of condensate and any other treatment fluid from the autoclave 1 into the storage container 4 or containers 4, 5 and to the discharge means through the conduit 12, and that the increased pressure required can be maintained, from the autoclave, in the or each storage container, for storing liquid at a temperature which is above its normal boiling point. Otherwise, a discharge pump and other conventional means would be required, in the discharge conduit, in order to ensure that the necessary increased pressure obtains in the storage container.

The simplest embodiment, as described above with reference to FIGS. 2*g*–2*j*, shows that the basic concept of the invention can already be used to advantage in a process which comprises free cooling of the treated material and the treatment apparatus. However, in accordance with the above-described embodiments, the apparatus will preferably be used at the same time for recovery of heat energy from the treated material, which is still hot, and the treatment apparatus, especially as in that connection about 50% of that heat energy can be recovered.

It will be seen therefore that the thermal content of the condensate can be used for a heat recovery or recycling effect, even when the vapour may have suffered contamination from the material to be treated, without thereby causing contamination and fouling of the boiler feed water.

Various other modifications and alterations may be made without thereby departing from the scope of the present invention as defined by the appended claims.

What is claimed is:

1. A process for stepwise treating a material, comprising the steps of: preheating the material in a preheating phase in a treatment apparatus; heating the preheated material in a heating phase by direct contact with steam in said treatment apparatus; cooling the heated material in the treatment apparatus after the heating phase, transferring contaminated water resulting from condensation of the steam in the heating phase in the treatment apparatus to at least one storage container for storage, feeding the contaminated water from the at least one storage container to the treatment apparatus for preheatiang fresh material therein in a subsequent operating cycle, and removing contaminated water after cooling from the treatment apparatus, the contaminated water being passed in the preheating phase from said at least one storage container to the treatment apparatus, the contaminated water produced in the heating phase being collected in the storage container, the cooling step including a first cooling stage in which the contaminated water is passed from the treatment apparatus into the storage container, and an equivalent amount of the contaminated water is removed from the process from the treatment apparatus in a preheating phase of a following operating cycle.

2. A process as set forth in claim 1, wherein the cooling step includes a cooling stage in which water is introduced into the treatment apparatus from an external source and passed on from the treatment apparatus to the storage container, and wherein in a subsequent stage in the process an equivalent amount of the contaminated water is removed from the process.

3. A process set forth in claim 1, wherein before being removed from the process, the contaminated water is successively stored in first and second storage containers at different average temperatures for use in two different operating cycles.

4. A process as set forth in claim 3, wherein contaminated water is passed to the treatment apparatus from the first and second storage containers which are at different average temperatures and after heat exchange in the treatment apparatus returned to the storage container at the appropriate average temperature, the contaminated water produced in the heating phase being supplied to the storage container having the highest average temperature.

5. A process as set forth in claim 4, wherein the cooling step includes a penultimate cooling stage in which water is passed into the treatment apparatus from an external source and then supplied to the storage container at the lowest average temperature, and wherein in one of the following treatment cycles, an equivalent amount of contaminated water is removed from the treatment apparatus.

6. A process as set forth in claim 5, wherein in a last cooling stage of the cooling step water is supplied to the treatment apparatus from an external source and then removed from the process from the treatment apparatus.

7. A process as set forth in claim 5, wherein in said penultimate cooling stage contaminated water is additionally supplied to the treatment apparatus from the storage container which is at the lowest average temperature.

8. A process as set forth in claim 4, wherein in a last cooling stage of the cooling step water is supplied to the treatment apparatus from an external source and then removed from the process from the treatment apparatus.

9. A process as set forth in claim 8, wherein in said penultimate cooling stage contaminated water is additionally supplied to the treatment apparatus from the storage container which is at the lowest average temperature.

* * * * *